US008070465B2

(12) United States Patent
Ginies et al.

(10) Patent No.: US 8,070,465 B2
(45) Date of Patent: Dec. 6, 2011

(54) OIL INJECTION CONTROL IN A COMPRESSOR WITH VARIABLE-SPEED COILS

(75) Inventors: Pierre Ginies, Sathonay Village (FR); Yves Rosson, Villars les Dombes (FR); Jean-Paul Bodart, Allee de Vaubecour (FR)

(73) Assignee: Danfoss Commercial Compressors, Rayrieux (FR)

( * ) Notice: Subject to any disclaimer, the term of this patent is extended or adjusted under 35 U.S.C. 154(b) by 516 days.

(21) Appl. No.: 12/219,515

(22) Filed: Jul. 23, 2008

(65) Prior Publication Data

US 2009/0041603 A1 Feb. 12, 2009

(30) Foreign Application Priority Data

Aug. 2, 2007 (FR) ..... 07 05667

(51) Int. Cl.
*F01C 21/04* (2006.01)
*F04C 29/02* (2006.01)
*F16N 7/36* (2006.01)

(52) U.S. Cl. ..... 418/94; 418/98; 184/6.18

(58) Field of Classification Search ..... 418/91, 418/94, 42, 98, 99, 87; 184/6.18
See application file for complete search history.

(56) References Cited

U.S. PATENT DOCUMENTS

| | | | |
|---|---|---|---|
| 6,287,099 | B1 | 9/2001 | Chang, II et al. |
| 2004/0156734 | A1 | 8/2004 | Furusho et al. |

FOREIGN PATENT DOCUMENTS

| | | | |
|---|---|---|---|
| JP | A-61-034383 | | 2/1986 |
| JP | A-61-192881 | | 8/1986 |
| JP | A-62-178791 | | 8/1987 |
| JP | 1-62-228694 | | 10/1987 |
| JP | A-63-032189 | | 2/1988 |
| JP | 01219383 | A * | 9/1989 |
| JP | 02005787 | A * | 1/1990 |
| JP | A-3-15601 | | 1/1991 |
| JP | 03237287 | A * | 10/1991 |
| JP | A-4-128586 | | 4/1992 |
| JP | A-09-264275 | | 10/1997 |
| JP | A-2003-254267 | | 9/2003 |
| JP | A-2006-336541 | | 12/2006 |

OTHER PUBLICATIONS

Mar. 18, 2009 International Search Report issued in PCT/FR2008/051391 (with English Translation).

* cited by examiner

*Primary Examiner* — Mary A Davis
(74) *Attorney, Agent, or Firm* — Oliff & Berridge, PLC

(57) ABSTRACT

This refrigerating compressor comprises a sealed chamber delimiting a suction volume and a compression volume arranged respectively either side of a body contained in the chamber, and an oil injection circuit arranged to inject oil into the compression volume. The oil injection circuit comprises a moving blocking piece, operated by a centrifugal force, between a first position enabling oil injection into the compression volume and a second position preventing or limiting oil injection into the compression volume, the blocking piece being arranged to be displaced into its second position when the speed of the compressor exceeds a predetermined value.

22 Claims, 6 Drawing Sheets

OIL INJECTION CONTROL IN A COMPRESSOR WITH VARIABLE-SPEED COILS

BACKGROUND OF THE INVENTION

The subject of the present invention is a refrigerating compressor with variable-speed coils.

The document FR 2 885 966 describes a coil compressor, also known as a scroll compressor, comprising a sealed chamber delimited by a shell and containing a suction volume and a compression volume arranged respectively either side of a body contained in the chamber. The shell delimiting the sealed chamber comprises a refrigerating gas inlet.

An electric motor is positioned inside the sealed chamber, with a stator located on the outside, mounted fixed relative to the shell, and a rotor in a central position, joined to a drive shaft, in the form of a crank shaft, a first end of which drives an oil pump feeding, from oil contained in a pan situated in the bottom part of the chamber, a lubrication pipe provided in the central part of the shaft. The lubrication pipe comprises lubrication orifices level with the various bearings guiding the drive shaft.

The compression volume contains a compression stage comprising a fixed volute fitted with a coil engaged in a coil of a moving volute, the two coils delimiting at least one compression chamber of variable volume. The second end of the drive shaft is fitted with an eccentric driving the moving volute in an orbital movement, to compress the refrigerating gas that is sucked in.

From a practical point of view, the refrigerating gas arrives from outside and penetrates into the sealed chamber. A portion of the gas is directly sucked in towards the compression volume, whereas the other portion of the gas passes through the motor before flowing towards the compression stage. All of the gas arriving either directly at the compression stage, or after passage through the motor, is sucked in by the compression stage, penetrating into at least one compression chamber delimited by the two coils, the inlet being at the periphery of the compression stage, and the gas being conveyed to the center of the coils as and when compression occurs by reduction of the volume of the compression chambers, resulting from the movement of the moving volute relative to the fixed volute. The compressed gas leaves in the central part towards the compressed gas recovery chamber.

According to the internal flow conditions of this type of compressor, the refrigerating gas entering into the compressor can be charged with oil, and this oil can originate, for example, from leaks from the bearings, from scrubbing of the surface of the oil pan by the gas.

It should be noted that the oil ratio in the refrigerating gas changes according to the rotation speed of the rotor of the electric motor.

Thus, at low rotor rotation speed, the quantity of oil circulating with the refrigerating gas is low, which can degrade the performance of the compressor and reduce the lubrication of the various parts of the compressor.

On the other hand, at high rotor rotation speed, the oil ratio in the refrigerating gas leaving the compressor can become excessive. The direct consequence of this excessive oil ratio in the gas is loss of efficiency of the heat exchange of the exchangers located downstream of the compressor, given the fact that the oil droplets contained in the gas have a tendency to be deposited on the exchangers and form a layer of oil on the latter.

Furthermore, an excessive oil ratio in the gas can also cause the oil pan to empty, which could lead to the destruction of the compressor.

DESCRIPTION OF THE PRIOR ART

The U.S. Pat. No. 6,287,099 describes a refrigerating compressor with variable-speed coils comprising a drive shaft comprising an oil feed pipe extending over the entire length of the latter, the oil feed pipe being fed with oil from oil contained in an oil pan by an oil pump arranged at a first end of the drive shaft. The drive shaft comprises a transverse orifice, one end of which discharges into the feed pipe and the other end of which discharges into the wall of the shaft, in an area of the latter located in the suction volume.

The compressor described in the U.S. Pat. No. 6,287,099 also comprises a blocking piece arranged to block the transverse orifice when the speed of the compressor is less than a predetermined value and to be displaced, and to free, by a centrifugal force, the transverse orifice when the speed of the compressor exceeds the predetermined value.

Thus, as long as the speed of the compressor is less than the predetermined value, the blocking piece blocks the transverse orifice. The result of this is that all of the oil having penetrated into the feed pipe is forced to the second end of the drive shaft and injected into the compression volume. When the speed of the compressor exceeds the predetermined value, the blocking piece frees the transverse orifice. The result of this is that a part of the oil having penetrated into the feed pipe is discharged by the transverse orifice and is not therefore injected into the compression volume.

Consequently, the compressor described in the U.S. Pat. No. 6,287,099 makes it possible to limit the oil injection into the compression volume when the speed of the compressor exceeds the predetermined value.

The compressor described in the U.S. Pat. No. 6,287,099 does, however, present a disadvantage associated with the structure of the drive shaft and the blocking piece.

In practice, when the speed of the compressor becomes high and exceeds a threshold value, the transverse orifice no longer makes it possible to divert a sufficient quantity of oil to the oil pan. The result of this is a large quantity of oil in the compression volume and therefore an excessive oil ratio in the refrigerating gas leaving the compressor.

SUMMARY OF THE INVENTION

The present invention aims to remedy these drawbacks, and its aim is to provide a refrigerating compressor with variable-speed coils which has a simple structure, while making it possible to accurately control the oil injection into the compression volume.

To this end, the present invention relates to a refrigerating compressor with variable-speed coils, comprising:

- a sealed chamber delimiting a suction volume and a compression volume arranged respectively either side of a body contained in the chamber, the compression volume containing a first volute and a second volute, the first and second volutes describing an orbital relative movement,
- an oil injection circuit arranged to inject oil into the compression volume,
- a drive shaft comprising an oil feed pipe extending over the entire length of the latter, fed with oil from oil contained in an oil pan by an oil pump arranged at a first end of the shaft, the second end of the drive shaft being fitted with a drive device, operating in an orbital movement, of the second volute contained in the compression volume, wherein the second volute comprises oil injection means arranged to place the feed pipe in communication with the compression volume, and wherein the oil injection circuit comprises a moving blocking piece, operated by a centrifugal force, between a first position freeing the oil injection means enabling oil injection into the compression volume and a second position blocking the oil injection means preventing oil injection into the compression volume, the blocking piece being arranged to be displaced into its second position when the speed of the compressor exceeds a predetermined value.

The presence of the blocking piece in the oil injection circuit makes it possible to accurately control the oil injection into the compression volume. In practice, as long as the speed of the compressor is low and therefore less than the predetermined value, the blocking piece makes it possible to inject oil into the compression volume whereas it prevents this oil injection when the speed of the compressor exceeds the predetermined value.

Thus, the inventive compressor makes it possible to increase the quantity of oil present in the compression volume, and therefore the oil ratio in the refrigerating gas, only when the speed of the compressor is low and less than the predetermined value.

The inventive compressor consequently makes it possible to enhance the low-speed performance of the variable-speed compressor without reducing its effectiveness at high speed.

Advantageously, the oil injection circuit comprises return means arranged on the one hand to maintain the blocking piece in its first position when the speed of the compressor is less than the predetermined value, and on the other hand to enable a movement of the blocking piece into its second position when the speed of the compressor exceeds the predetermined value.

According to one embodiment of the invention, the second end of the drive shaft comprises a recess in which the blocking piece is received, the injection means provided in the second volute comprise an orifice discharging level with the second end of the drive shaft, and the blocking piece is arranged on the one hand to block the orifice provided in the second volute when it is in its second position, and on the other hand to free the orifice provided in the second volute when it is in its first position.

According to another embodiment of the invention, the blocking piece comprises a through-orifice arranged on the one hand to be located facing the orifice provided in the second volute when the blocking piece is in its first position, and on the other hand to be offset from the orifice provided in the second volute when the blocking piece is in its second position.

Advantageously, the return means comprise a spring positioned in the recess provided in the drive shaft, the two ends of the spring bearing respectively against the blocking piece and the drive shaft.

According to another embodiment, the second volute bears against the body, and the compressor also comprises a cartridge arranged between the second volute and the body and in which the blocking piece is received, the cartridge being linked to the body and to the second volute via a first and a second rotating link, the distance between the axes of the two rotating links being equal to the orbital radius of the second volute, and the cartridge being driven rotationally around one of the rotating links during the relative movement between the second volute and the body.

Preferably, the cartridge is cylindrical and fitted free to rotate in a recess of complementary shape provided in one of the elements out of the body and the second volute, this mounting of the cartridge in the recess forming a rotating link combined with the axis of the cartridge. The cartridge comprises an orifice in which a pin is received that is fitted in the other element out of the body and the second volute, this pin forming a rotating link offset relative to the axis of the cartridge.

In this case, the oil injection circuit can, according to one embodiment of the invention, comprise an oil feed pipe positioned inside the sealed chamber and discharging on the one hand into the oil pan and on the other hand into the recess receiving the cartridge.

Advantageously, the return means comprise a spring arranged in the cartridge, the two ends of the spring bearing respectively against the blocking piece and the cartridge.

According to another characteristic of the invention, the oil injection means comprise a first injection channel provided in the second volute, one end of which discharges level with the second end of the feed pipe and the other end of which discharges into the recess receiving the cartridge, and an orifice provided in the second volute one end of which discharges into the recess receiving the cartridge and the other end of which discharges into a second injection channel provided in the second volute, the second injection channel discharging into the compression volume, and the blocking piece is arranged on the one hand to block the orifice provided in the second volute when it is in its second position, and on the other hand to free the orifice provided in the second volute when it is in its first position.

Preferably, the blocking piece comprises a through-orifice arranged on the one hand to place the first injection channel and the orifice provided in the second volute in communication when the blocking piece is in its first position, and on the other hand to be offset from the orifice provided in the second volute when the blocking piece is in its second position.

According to yet another characteristic of the invention, the oil injection means comprise a first injection channel provided in the second volute, one end of which discharges level with the second end of the feed pipe and the other end of which discharges into the recess receiving the cartridge, and a second injection channel provided in the second volute one end of which discharges into the recess receiving the cartridge and the other end of which discharges into the compression volume, and the cartridge comprises a through-orifice arranged on the one hand to place the first and second injection channels provided in the second volute in communication when the blocking piece is in its first position, and on the other hand to be blocked by the blocking piece when it is in its second position.

Preferably, the recess receiving the cartridge is provided in the body and the pin is mounted in the second volute, and the end of the first injection channel discharging into the recess receiving the cartridge forms an orifice in which the pin is mounted, the pin comprising a through-bore arranged to place the first injection channel in communication with the through-orifice provided in the cartridge when the blocking piece is in its first position.

According to yet another characteristic of the invention, the oil injection means are arranged to feed oil to the interface between the body and the second volute when the blocking piece is in the first position.

Advantageously, the first and second volutes delimit at least one compression chamber with variable volume, and the oil injection means are arranged to inject oil into an inlet portion of the compression chamber when the blocking piece is in the first position.

In any case, the invention will be well understood from the following description, given with reference to the indexed schematic drawing which represents, by way of nonlimiting examples, several embodiments of this coil compressor.

BRIEF DESCRIPTION OF THE DRAWINGS

In the description that follows, the same elements are designated by the same references in the various embodiments.

DESCRIPTION OF THE PREFERRED EMBODIMENTS

Figure 1:
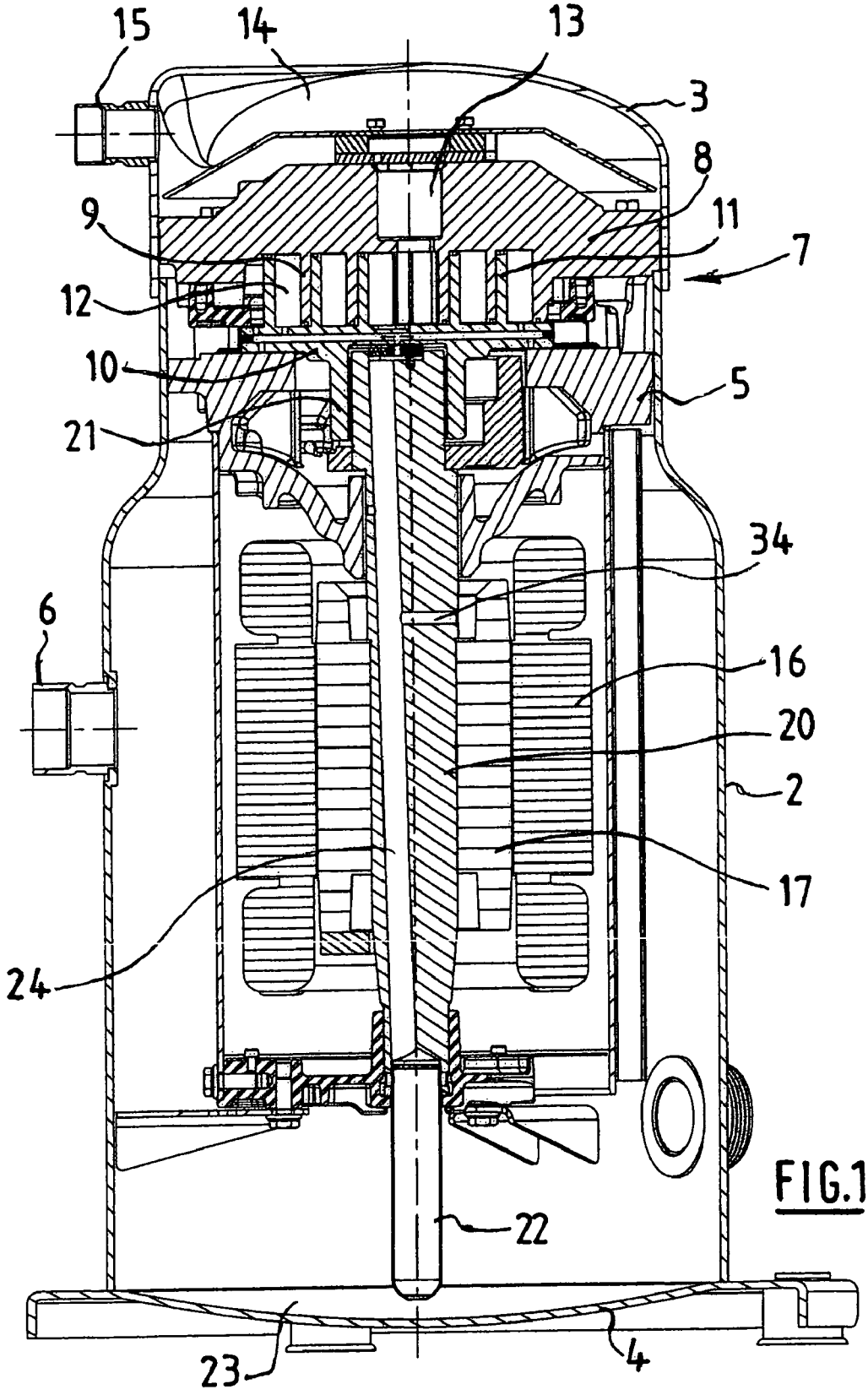
FIG. 1 is a longitudinal cross-sectional view of a first compressor.

FIG. 1 describes a refrigerating compressor with variable-speed coils occupying a vertical position. However, the inventive compressor could occupy a tilted position, or even a horizontal position, without its structure being modified significantly.

The compressor represented in FIG. 1 comprises a sealed chamber delimited by a shell 2, the top and bottom ends of which are closed respectively by a cover 3 and a base 4. This chamber can be assembled notably by means of weld beads.

The intermediate part of the compressor is occupied by a body 5 which delimits two volumes, a suction volume located below the body 5, and a compression volume positioned above the latter. The shell 2 comprises a refrigerating gas inlet 6 discharging into the suction volume to direct the gas to the compressor.

The body 5 provides the mounting for a compression stage 7 of the refrigerating gas. This compression stage 7 comprises a fixed volute 8 fitted with a fixed coil 9 turned downwards, and a moving volute 10 bearing against the body 5 and fitted with a coil 11 turned upwards. The two coils 9 and 11 of the two volutes interpenetrate to provide compression chambers 12 with variable volume. The intake of gas into the compression stage takes place from the outside, the compression chambers 12 having a variable volume which reduces from outside to inside, when the moving volute 10 moves relative to the fixed volute 8, the compressed gas escaping at the center of the volutes through an opening 13 provided in the fixed volute 8 towards a high-pressure chamber 14 from which it is evacuated via a coupling 15.

The compressor comprises an electric motor positioned in the suction volume. The speed variation of the electric motor can be obtained by means of a variable-frequency electric generator.

The electric motor comprises a stator 16 at the center of which is positioned a rotor 17.

The rotor 17 is joined to a drive shaft 20, the top end of which is offset in the manner of a crank shaft. This top part is engaged in a sleeve-shaped part 21, comprised in the moving volute 10. When driven rotationally by the motor, the drive shaft 20 drives the moving volute 10 in an orbital movement.

The bottom end of the drive shaft 20 drives an oil pump 22 that feeds, from oil contained in a pan 23 delimited by the base 4, an oil feed pipe 24 provided in the central part of the drive shaft.

The feed pipe 24 is offset and extends over the entire length of the drive shaft 20.

Figure 2:
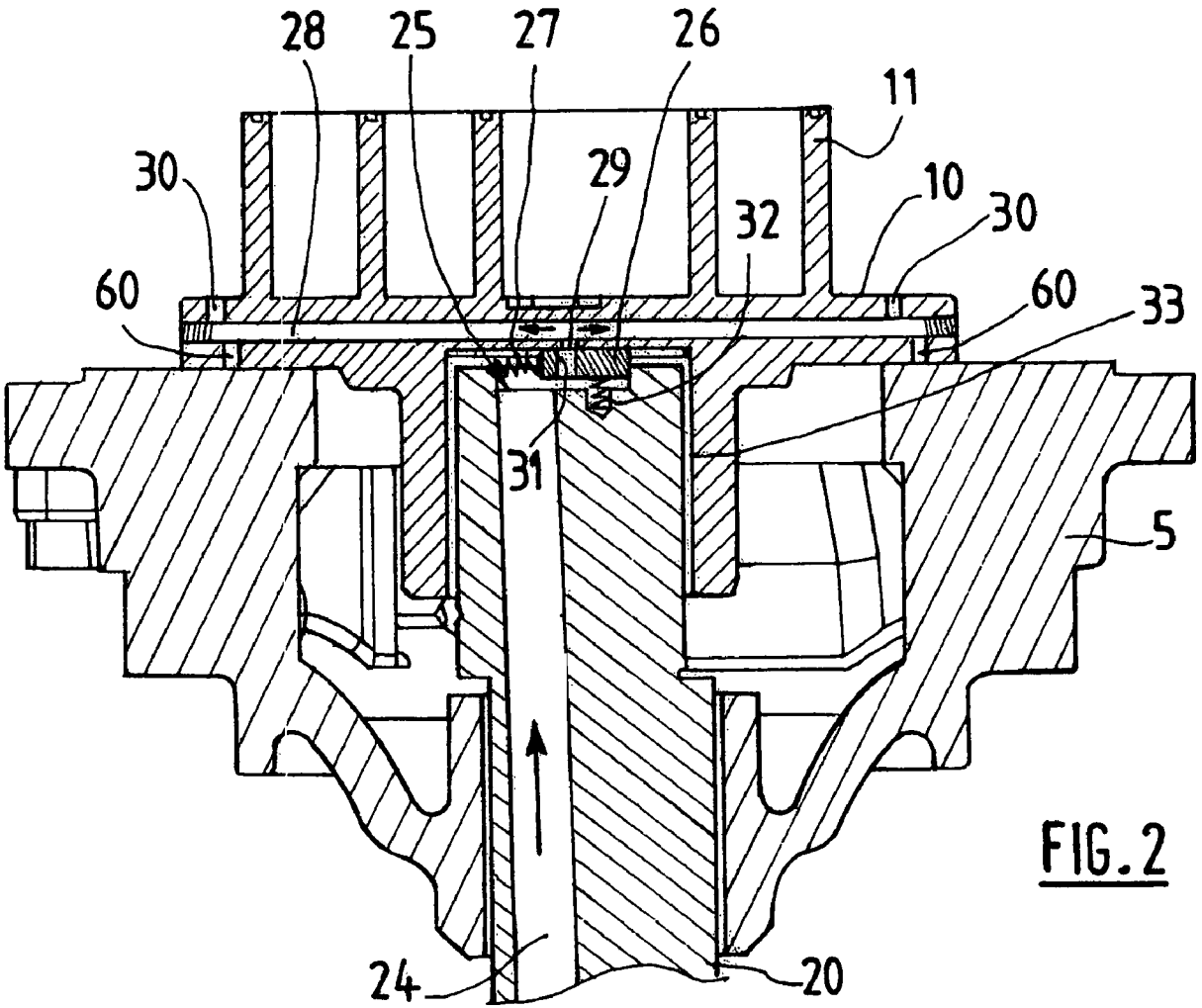
FIGS. 2 and 3 are partial longitudinal cross-sectional views, on an enlarged scale, of the compressor of FIG. 1.

The top end of the drive shaft 20 comprises a recess 25 in which is mounted to slide a blocking piece 26, as is shown in FIG. 2. As shown notably in FIG. 1, the blocking piece 26 is positioned in the compression volume.

Figure 3:
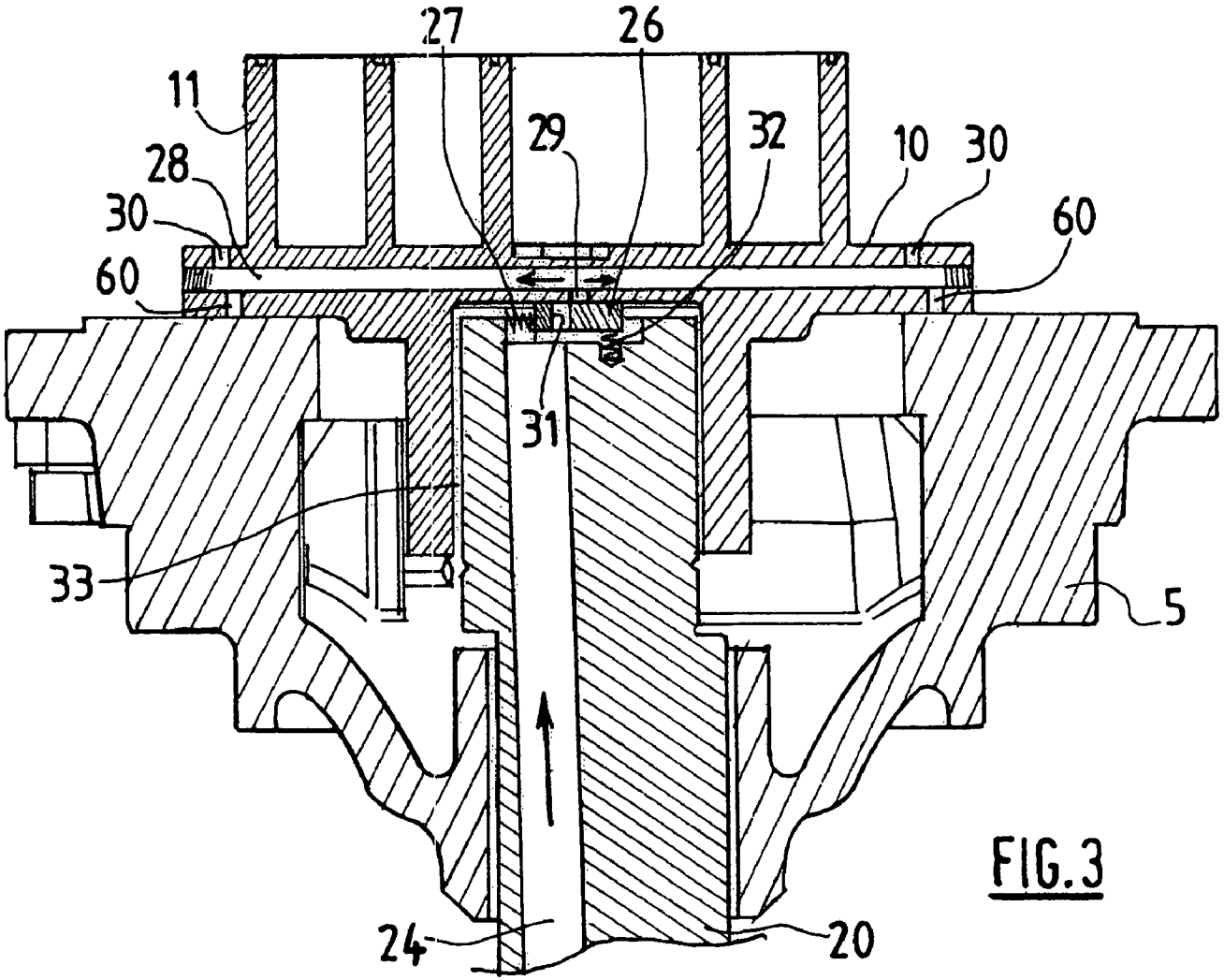

The blocking piece 26 comprises a moving blocking drawer, operated by the centrifugal force due to the rotation of the drive shaft 20, between a first position (represented in FIGS. 1 and 2) enabling oil injection into the compression volume and a second position (represented in FIG. 3) preventing oil injection into the compression volume.

The oil injection circuit comprises return means arranged on the one hand to maintain the blocking piece 26 in its first position when the speed of the compressor is less than a predetermined value, and on the other hand to enable a displacement of the blocking piece 26 into its second position when the speed of the compressor exceeds the predetermined value.

The return means comprise a compression spring 27 positioned in the recess 25, the two ends of the spring 27 bearing respectively against the blocking piece 26 and the drive shaft 20.

The moving volute 10 comprises oil injection means arranged on the one hand to place the feed pipe 24 in communication with the compression volume and on the other hand to feed oil to the interface between the body 5 and the moving volute 10 when the blocking piece 26 is in its first position.

The injection means provided in the moving volute 10 comprise a rectilinear injection channel 28 extending into the base of the moving volute, a first orifice 29 discharging respectively into the injection channel 28 and level with the second end of the drive shaft 20, and second and third orifices 30 discharging respectively into the injection channel 28 and into the inlet portion of the compression chambers 12. The injection means provided in the moving volute 10 also comprise fourth and fifth orifices 60 discharging respectively into the injection channel 28 and into the interface between the body 5 and the moving volute 10.

The blocking piece 26 comprises a through-orifice 31 arranged on the one hand to be located facing the first orifice 29 provided in the moving volute 10 when the blocking piece 26 is in its first position, and on the other hand to be offset from the first orifice 29 when the blocking piece 26 is in its second position.

Thus, the through-orifice 31 makes it possible to place the feed pipe 24 in communication with the injection channel 28 provided in the moving volute 10 when the blocking piece 26 is in its first position.

It should be noted that the blocking piece 26 blocks the first orifice 29 provided in the moving volute 10 when it is in its second position.

The compressor comprises a second compression spring 32 bearing respectively against the drive shaft 20 and the bottom face of the blocking piece 26, this second spring 32 being arranged to maintain the blocking piece 26 pressed against the moving volute 10 during its displacements so as to ensure a watertight blocking of the orifice 29 when the blocking piece 26 is in its second position.

The operation of the coil compressor will now be described.

When the inventive coil compressor is switched on, the rotor 17 rotationally drives the drive shaft 20 and the oil pump 22 feeds, from oil contained in the pan 23, the lubrication pipe 24. Because of the rotation of the drive shaft 20, the oil pumped by the pump 22 will flow in the lubrication pipe 24 towards the blocking piece 26.

As long as the speed of the compressor is less than the predetermined value, the compression spring 27 maintains the blocking piece 26 in its first position.

The result of this is that the through-orifice 31 provided in the blocking piece is positioned facing the orifice 29 provided in the moving volute 10 and therefore allows on the one hand oil injection into the compression volume via the injection channel 28 and the orifices 30, and on the other hand oil feed to the interface between the body 5 and the moving volute via the injection channel 28 and orifices 60.

When the speed of the compressor exceeds the predetermined value, the blocking piece 26 compresses, under the effect of its weight and the centrifugal force, the compression spring 27 and is displaced into its second position. The result of this is that the orifice 29 is blocked by the blocking piece 26 and therefore that the oil having penetrated into the feed pipe 24 can no longer flow into the compression volume.

The inventive compressor makes it possible to increase the quantity of oil present in the compression volume, and therefore the oil ratio in the refrigerating gas, only when the speed of the compressor is low and less than the predetermined value. The present invention makes it possible to enhance the low-speed performance of the variable-speed compressor without reducing its effectiveness at high speed.

It should be specified that, when the blocking piece 26 is in its second position, the oil having penetrated into the feed pipe 24 is evacuated on the one hand level with the top bearing 33 and serves to lubricate it, and on the other hand via a radial orifice 34 provided in the drive shaft 20, one end of which discharges into the feed pipe 24 and the other end of which discharges into the wall of the shaft 20, level with the rotor 17.

Figure 4:
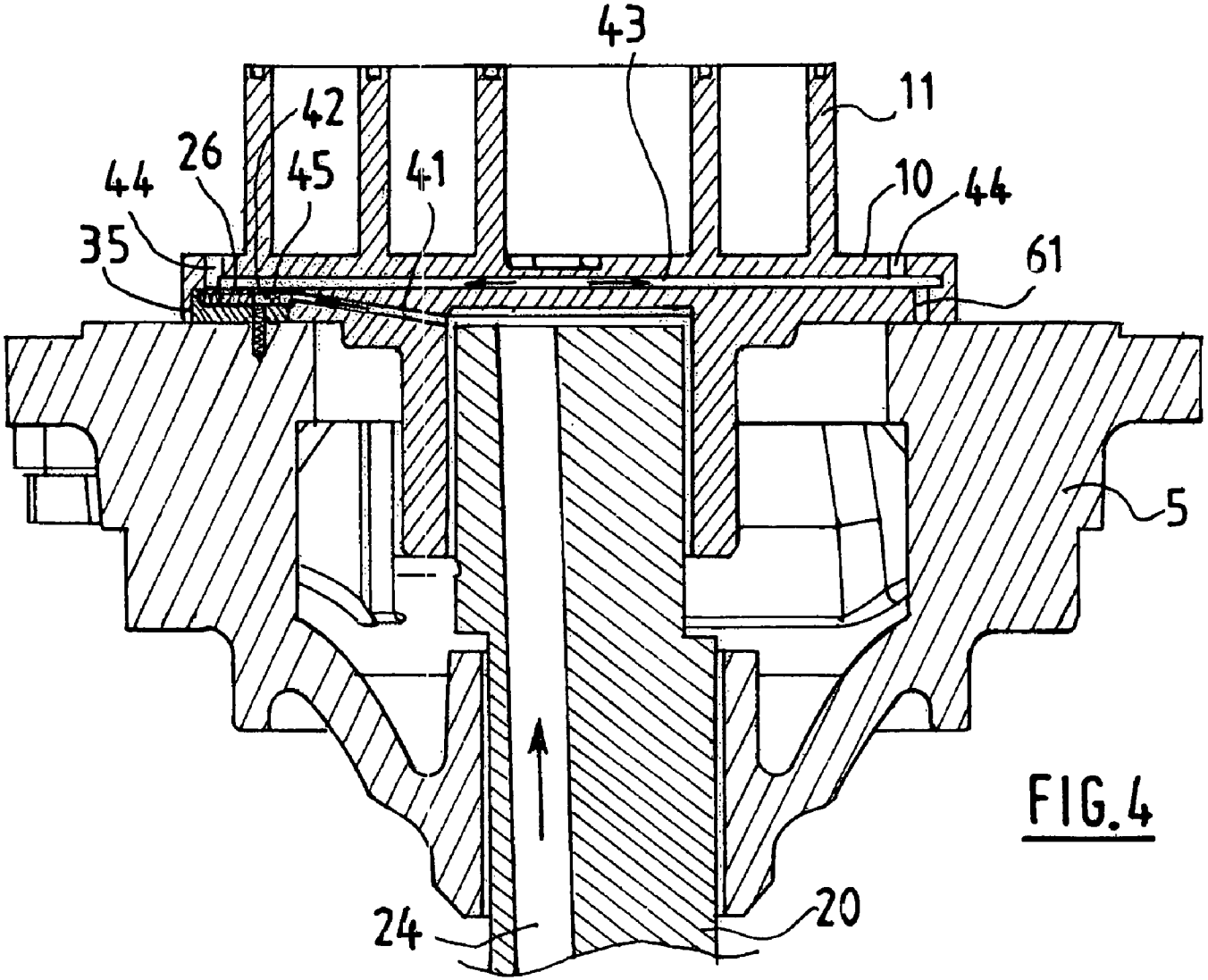
FIG. 4 is a partial longitudinal cross-sectional view of a second compressor.
Figure 5:
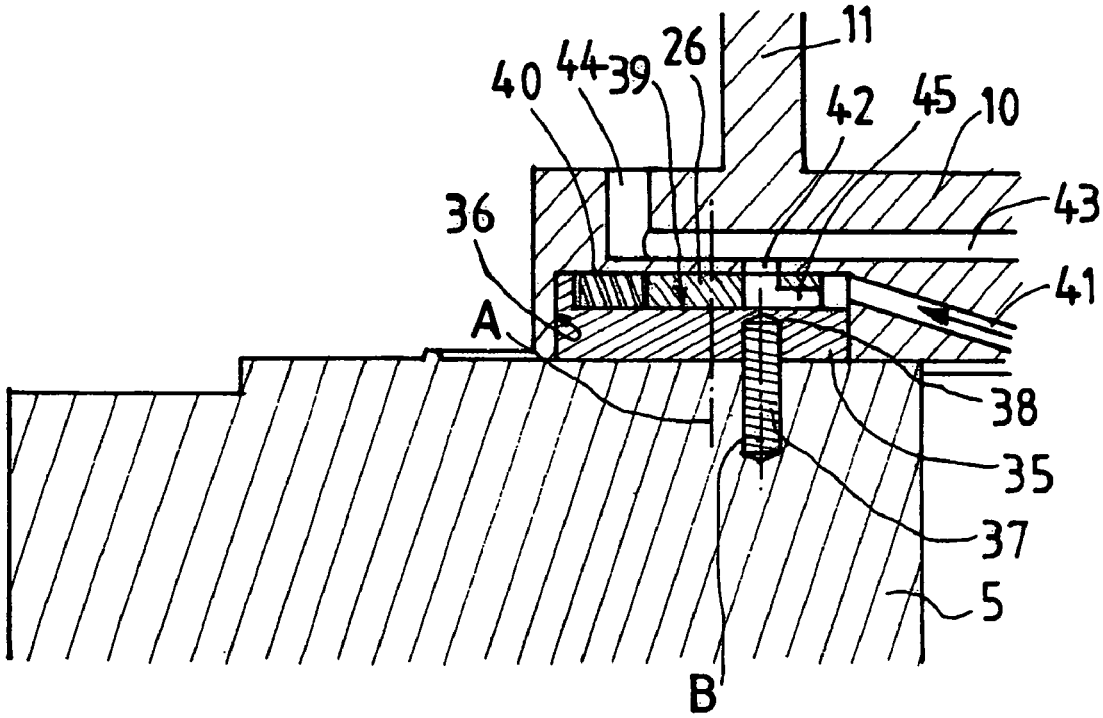
FIGS. 5 and 6 are partial longitudinal cross-sectional views, on an enlarged scale, of the compressor of FIG. 4.
Figure 6:
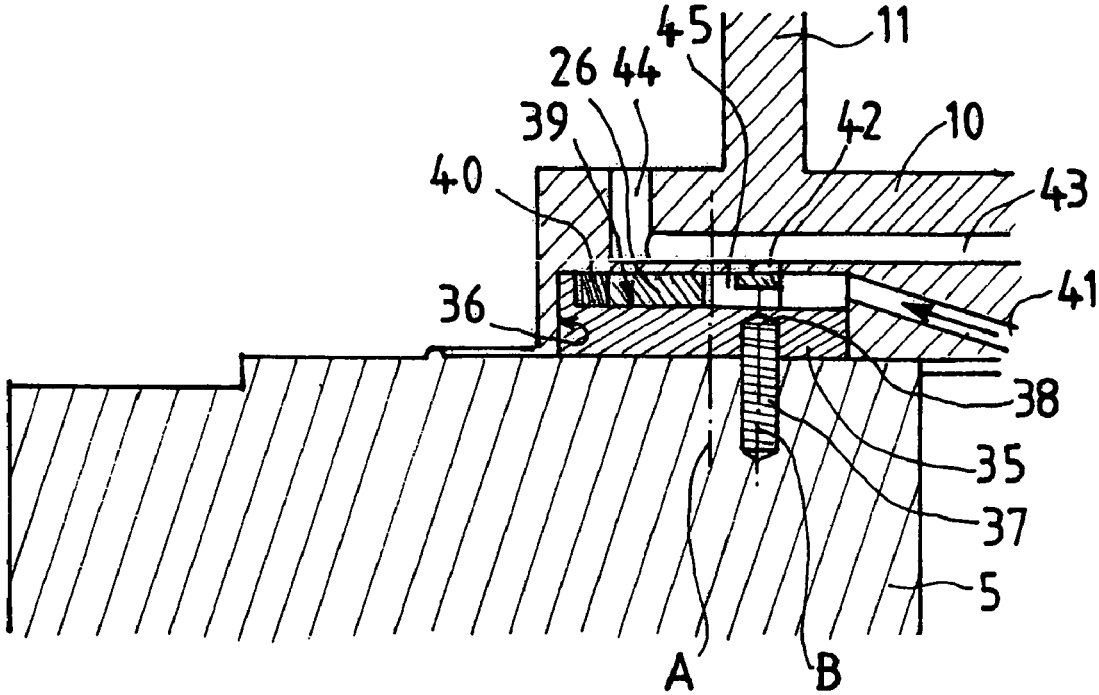

FIGS. 4 to 6 represent a second embodiment of the invention.

According to this embodiment, the compressor comprises a cylindrical cartridge 35 fitted free to rotate about its axis A in a recess 36 of complementary shape provided in the moving volute 10 and discharging into the face of the latter turned towards the body 5. The cartridge 35 is driven rotationally about its axis A, during the relative orbital movement between the moving volute 10 and the body 5, via a pin 37 joined to the body 5 and received in an orifice 38 of complementary shape provided in the cartridge 35. It should be noted that the cartridge 35 is mounted free to rotate about the axis B of the pin 37.

The cartridge 35 is driven rotationally about its axis A during the relative movement between the body 5 and the moving volute 10 because the distance between the axis A of the cartridge 35 and the axis B of the pin 37 is equal to the orbital radius of the moving volute 10.

The cartridge 35 comprises a recess 39 in which is mounted to slide the blocking piece 26. The blocking piece 26 comprises a moving blocking drawer, operated by the centrifugal force due to the rotation of the cartridge 35, between a first position (represented in FIGS. 4 and 5) enabling oil injection into the compression volume and a second position (represented in FIG. 6) preventing oil injection into the compression volume.

According to this embodiment, the return means provided consist of a compression spring 40 positioned in the recess 39 receiving the blocking piece 26, the two ends of the spring 40 bearing respectively against the blocking piece 26 and the cartridge 35.

The oil injection means arranged to place the feed pipe 24 in communication with the compression volume when the blocking piece 26 is in its first position comprise:

- a first injection channel 41 provided in the moving volute 10, one end of which discharges level with the second end of the feed pipe 24 and the other end of which discharges into the recess 36 receiving the cartridge 35,
- an orifice 42 provided in the moving volute 10, one end of which discharges into the recess 36 receiving the cartridge 35 and the other end of which discharges into a second injection channel 43 provided in the moving volute 10, the second injection channel 43 discharging on the one hand into the inlet portion of the compression chambers 12 via two injection orifices 44, and on the other hand into the interface between the body 5 and the moving volute 10 via an orifice 61.

The blocking piece 26 is arranged on the one hand to block the orifice 42 provided in the moving volute 10 when it is in its second position, and on the other hand to free it when its is in its first position.

The blocking piece 26 comprises a through-orifice 45 arranged on the one hand to place the first injection channel 41 and the orifice 42 provided in the moving volute 10 in communication when the blocking piece 26 is in its first position, and on the other hand to be offset from the orifice 42 provided in the moving volute 10 when the blocking piece 26 is in its second position.

Thus, the through-orifice 45 makes it possible to place the feed pipe 24 in communication with the second injection channel 43 provided in the moving volute 10 when the blocking piece 26 is in its first position.

The operation of the coil compressor according to this second embodiment will now be described.

As long as the speed of the compressor is less than the predetermined value, the compression spring 40 maintains the blocking piece 26 in its first position. The result of this is that the through-orifice 45 provided in the blocking piece 26 is positioned facing the orifice 42 provided in the moving volute 10 and therefore allows on the one hand oil injection into the compression volume via the injection channels 41, 43 and the orifices 44, and on the other hand oil feed to the interface between the body 5 and the moving volute 10 via the injection channels 41, 43 and the orifice 61.

When the speed of the compressor exceeds the predetermined value, the blocking piece 26 compresses, under the effect of its weight and the centrifugal force, the compression spring 40 and is displaced into its second position. The result of this is that the orifice 42 is blocked by the blocking piece 26 and therefore that the oil having penetrated into the feed pipe 24 can no longer flow into the compression volume.

Figure 7:
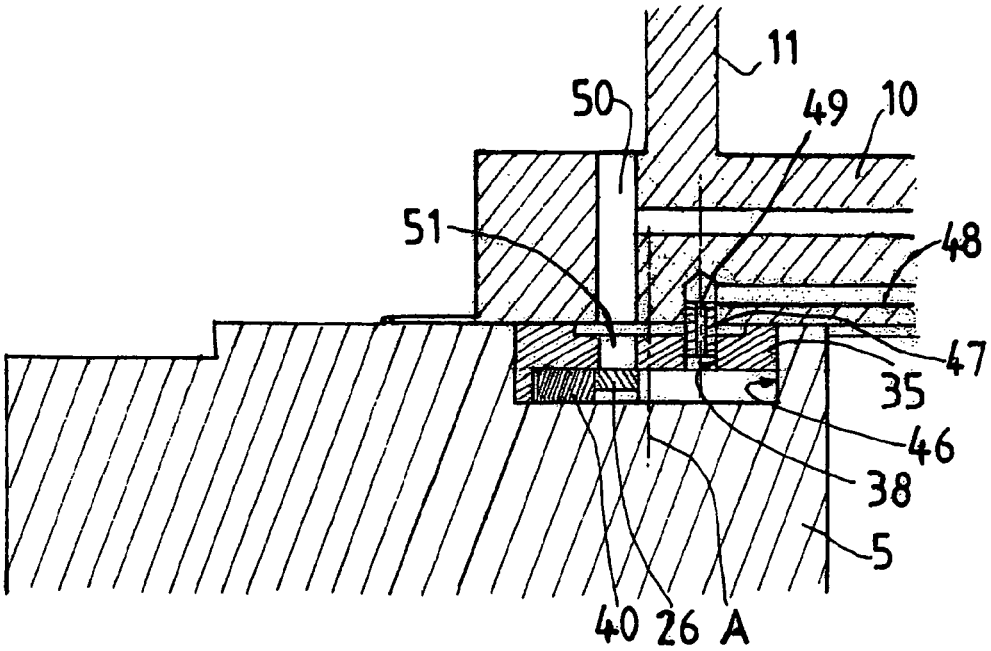
FIGS. 7 and 8 are partial longitudinal cross-sectional views, on an enlarged scale, of a third compressor.
Figure 8:
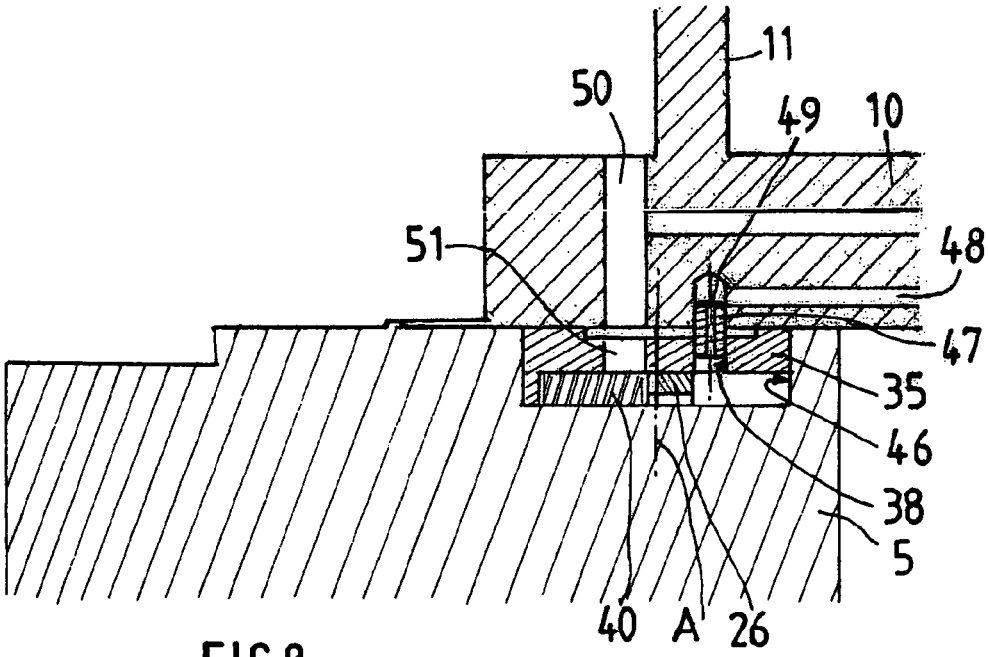

FIGS. 7 to 8 represent a third embodiment of the invention which differs from the second embodiment essentially in that the cartridge 35 is fitted free to rotate about its axis A in a recess 46 of complementary shape provided in the body 5 and discharging into the face of the latter turned towards the moving volute 10.

The cartridge 35 is driven rotationally about its axis A, during the relative orbital movement between the moving volute 10 and the body 5, via a pin 47 joined to the moving volute 10 and received in an orifice 38 of complementary shape provided in the cartridge 35.

According to this embodiment, the oil injection means comprise:

- a first injection channel 48 provided in the moving volute 10, one end of which discharges level with the second end of the feed pipe 24 and the other end of which forms an orifice in which the pin 47 is mounted, the pin 47 comprising a through-bore 49 discharging respectively into the first injection channel 48 and into the recess 46 receiving the cartridge, a second injection channel 50 provided in the moving volute 10, one end of which discharges into the recess 46 receiving the cartridge and the other end of which discharges into the inlet portion of the compression chambers 12.

The cartridge 35 comprises a through-orifice 51 arranged on the one hand to place the first and second injection channels 48, 50 provided in the moving volute 10 in communication via the bore 49 when the blocking piece 26 is in its first position, and on the other hand to be blocked by the blocking piece when it is in its second position.

Obviously, the invention is not limited to only the embodiments of this refrigerating compressor described hereinabove by way of examples; on the contrary, it encompasses all embodiment variants.

The invention claimed is:

1. A refrigerating compressor with variable-speed coils, comprising:

a sealed chamber delimiting a suction volume and a compression volume arranged respectively on either side of a body contained in the sealed chamber, the compression volume containing a first volute and a second volute, the first and second volutes describing an orbital relative movement, an oil injection circuit arranged to inject oil into the compression volume, a drive shaft comprising an oil feed pipe extending over an entire length of the drive shaft, the oil feed pipe being fed with oil from an oil pan by an oil pump arranged at a first end of the drive shaft, a second end of the drive shaft being fitted with a drive device, operating in an orbital movement, of the second volute contained in the compression volume, wherein the second volute comprises oil injection means arranged to place the oil feed pipe in communication with the compression volume, and the oil injection circuit comprises a moving blocking piece, operated by a centrifugal force, between a first position freeing the oil injection means enabling oil injection into the compression volume and a second position blocking the oil injection means preventing oil injection into the compression volume, the blocking piece being arranged to be displaced into the second position when a speed of the refrigerating compressor exceeds a predetermined value.

2. The refrigerating compressor as claimed in claim 1, wherein the oil injection circuit further comprises return means arranged to maintain the blocking piece in the first position when the speed of the refrigerating compressor is less than the predetermined value, and to enable a displacement of the blocking piece into the second position when the speed of the refrigerating compressor exceeds the predetermined value.

3. The refrigerating compressor as claimed in claim 2, wherein the return means further comprise a spring positioned in the recess provided in the second end of the drive shaft, each end of the spring bearing respectively against the blocking piece and the drive shaft.

4. The refrigerating compressor as claimed in claim 1, wherein the second end of the drive shaft comprises a recess in which the blocking piece is received, the oil injection means further comprise an orifice provided in the second volute and discharging level with the second end of the drive shaft, and the blocking piece is arranged to block the orifice provided in the second volute when the blocking piece is in the second position, and the blocking piece is arranged to free the orifice provided in the second volute when the blocking piece is in the first position.

5. The refrigerating compressor as claimed in claim 4, wherein the blocking piece comprises a through-orifice arranged to be facing the orifice provided in the second volute when the blocking piece is in the first position, and the through-orifice being arranged to be offset from the orifice provided in the second volute when the blocking piece is in the second position.

6. The refrigerating compressor as claimed in claim 1, wherein the second volute bears against the body, the refrigerating compressor further comprises a cartridge arranged between the second volute and the body, in which the blocking piece is received, the cartridge is linked to the body and to the second volute via a first and a second rotating link, the distance between axes of the first and second rotating links is equal to an orbital radius of the second volute, and the cartridge is driven rotationally around one of the first and second rotating links during the relative movement between the second volute and the body.

7. The refrigerating compressor as claimed in claim 6, wherein the cartridge is cylindrical and fitted free to rotate in a recess of complementary shape provided in one element of a plurality of elements out of the body and the second volute, the mounting of the cartridge in the recess forms one of the first and second rotating links combined with an axis of the cartridge, the cartridge comprises an orifice in which a pin is received, the pin is fitted in an other element out of the plurality elements out of the body and the second volute, the pin forms an other of the first and second rotating links offset relative to the axis of the cartridge.

8. The refrigerating compressor as claimed in claim 7, wherein the oil injection means further comprise a first injection channel provided in the second volute, one end of the first injection channel discharges level with a second end of the oil feed pipe and an other end of the first injection channel discharges into the recess receiving the cartridge, and an orifice provided in the second volute, one end of the orifice discharges into the recess receiving the cartridge and an other end of the orifice discharges into a second injection channel provided in the second volute, the second injection channel discharging into the compression volume, and the blocking piece is arranged to block the orifice provided in the second volute when the blocking piece is in the second position, and the blocking piece is arranged to free the orifice provided in the second volute when the blocking piece is in the first position.

9. The refrigerating compressor as claimed in claim 8, wherein the blocking piece further comprises a through-orifice arranged to place the first injection channel and the orifice provided in the second volute in communication when the blocking piece is in the first position, and the through-orifice arranged to be offset from the orifice provided in the second volute when the blocking piece is in the second position.

10. The refrigerating compressor as claimed in claim 7, wherein the oil injection means further comprise a first injection channel provided in the second volute, one end of the first injection channel discharges level with a second end of the oil feed pipe and an other end of the first injection channel discharges into the recess receiving the cartridge, and a second injection channel provided in the second volute, one end of the second injection channel discharges into the recess receiving the cartridge and an other end of the second injection channel discharges into the compression volume, and the cartridge further comprises a through-orifice arranged to place the first and second injection channels provided in the second volute in communication when the blocking piece is in the first position, and the through-orifice arranged to be blocked by the blocking piece when the blocking piece is in the second position.

11. The refrigerating compressor as claimed in claim 10, wherein the recess receiving the cartridge is provided in the body and the pin is mounted in the second volute, and the end of the first injection channel discharging into the recess receiving the cartridge forms an orifice in which the pin is mounted, the pin comprising a through-bore arranged to place the first injection channel in communication with the through-orifice provided in the cartridge when the blocking piece is in the first position.

12. The refrigerating compressor as claimed in claim 6, wherein the oil injection circuit comprises return means that comprise a spring arranged in the cartridge, each end of the spring bearing respectively against the blocking piece and the cartridge.

13. The refrigerating compressor as claimed in claim 1, wherein the oil injection means are arranged to feed oil to the interface between the body and the second volute when the blocking piece is in the first position.

14. A refrigerating compressor with variable-speed coils, comprising:

a sealed chamber delimiting a suction volume and a compression volume arranged respectively either side of a body contained in the sealed chamber, the compression volume containing a first volute and a second volute, the first and second volutes describing an orbital relative movement, a drive device operating in an orbital movement, of the second volute contained in the compression volume, the second volute bearing against the body, an oil injection circuit arranged to inject oil into the compression volume, the oil injection circuit comprising a moving blocking piece, operated by a centrifugal force, between a first position enabling oil injection into the compression volume and a second position preventing oil injection into the compression volume, the blocking piece being arranged to be displaced into the second position when speed of the refrigerating compressor exceeds a predetermined value, wherein the refrigerating compressor comprises a cartridge arranged between the second volute and the body, in which the blocking piece is received, the cartridge being linked to the body and to the second volute via a first and a second rotating link, the distance between axes of the first and second rotating links is equal to an orbital radius of the second volute, and the cartridge is driven rotationally around one of the first and second rotating links during the relative movement between the second volute and the body.

15. The refrigerating compressor as claimed in claim 14, wherein the cartridge is cylindrical and fitted free to rotate in a recess of complementary shape provided in one element of a plurality of elements out of the body and the second volute, the mounting of the cartridge in the recess forms one of the first and second rotating links combined with an axis of the cartridge, the cartridge comprises an orifice in which a pin is received, the pin is fitted in an other element out of the plurality of elements out of the body and the second volute, and the pin forms one of the first and second rotating links offset relative to the axis of the cartridge.

16. The refrigerating compressor as claimed in claim 15, wherein the refrigerating compressor further comprises a drive shaft comprising an oil feed pipe extending over an entire length of the drive shaft, the oil feed pipe being fed with oil from an oil pan by an oil pump arranged at a first end of the drive shaft, a second end of the drive shaft being fitted with the drive device, and the second volute comprises oil injection means arranged to place the oil feed pipe in communication with the compression volume.

17. The refrigerating compressor as claimed in claim 16, wherein the oil injection means further comprise a first injection channel provided in the second volute, one end of the first injection channel discharges level with a second end of the oil feed pipe and an other end of the first injection channel discharges into the recess receiving the cartridge, and an orifice provided in the second volute, one end of the orifice discharges into the recess receiving the cartridge and an other end of the orifice discharges into a second injection channel provided in the second volute, the second injection channel discharging into the compression volume, and the blocking piece is arranged to block the orifice provided in the second volute when the blocking piece is in the second position, and the blocking piece is arranged to free the orifice provided in the second volute when the blocking piece is in the first position.

18. The refrigerating compressor as claimed in claim 17, wherein the blocking piece further comprises a through-orifice arranged to place the first injection channel and the orifice provided in the second volute in communication when the blocking piece is in the first position, and the through-orifice arranged to be offset from the orifice provided in the second volute when the blocking piece is in the second position.

19. The refrigerating compressor as claimed in claim 16, wherein the oil injection means comprise a first injection channel provided in the second volute, one end of the first injection channel discharges level with a second end of the oil feed pipe and an other end of the first injection channel discharges into the recess receiving the cartridge, and a second injection channel provided in the second volute, one end of the second injection channel discharges into the recess receiving the cartridge and an other end of the second injection channel discharges into the compression volume, and the cartridge comprises a through-orifice arranged to place the first and second injection channels provided in the second volute in communication when the blocking piece is in the first position, and the through-orifice arranged to be blocked by the blocking piece when the blocking piece is in the second position.

20. The refrigerating compressor as claimed in claim 19, wherein the recess receiving the cartridge is provided in the body and the pin is mounted in the second volute, and the end of the first injection channel discharging into the recess receiving the cartridge forms an orifice in which the pin is mounted, the pin comprising a through-bore arranged to place the first injection channel in communication with the through-orifice provided in the cartridge when the blocking piece is in the first position.

21. The refrigerating compressor as claimed in claim 16, wherein the oil injection means are arranged to feed oil to the interface between the body and the second volute when the blocking piece is in the first position.

22. The refrigerating compressor as claimed in claim 14, wherein the oil injection circuit further comprises return means arranged to maintain the blocking piece in the first position when the speed of the refrigerating compressor is less than the predetermined value, and the return means arranged to enable a movement of the blocking piece into the second position when the speed of the refrigerating compressor exceeds the predetermined value, and the return means comprising a spring arranged in the cartridge, each end of the spring bearing respectively against the blocking piece and the cartridge.

* * * * *